United States Patent [19]

Jones

[11] Patent Number: 4,591,960

[45] Date of Patent: May 27, 1986

[54] LIGHTING OPTICAL SYSTEM

[75] Inventor: Bill F. Jones, Orange, Calif.

[73] Assignee: MWC Lighting, Fountain Valley, Calif.

[21] Appl. No.: 656,945

[22] Filed: Oct. 2, 1984

[51] Int. Cl.[4] ..... F21V 7/00

[52] U.S. Cl. ..... 362/298; 362/302; 362/346

[58] Field of Search ..... 362/296, 297, 298, 302, 362/305, 342, 343, 346, 347, 349, 257, 303

[56] References Cited

U.S. PATENT DOCUMENTS

| | | | |
|---|---|---|---|
| 1,270,261 | 6/1918 | Brueggeman | 362/302 |
| 1,286,535 | 12/1918 | Cochran | 362/302 |
| 2,135,694 | 11/1938 | Bardwell et al. | 423/351 |
| 2,198,014 | 4/1940 | Ott | 362/253 |
| 2,899,543 | 8/1959 | Rasmussen | D26/112 |
| 3,115,310 | 12/1963 | Hofman | 362/292 |
| 3,593,014 | 7/1971 | Vesely | 362/263 |
| 3,836,767 | 9/1974 | Lasker | 362/303 |
| 4,001,575 | 1/1977 | Sullivan et al. | 362/263 |
| 4,007,365 | 2/1977 | Stempfle et al. | 362/283 |
| 4,096,555 | 6/1978 | Lasker | 362/302 |
| 4,231,080 | 10/1980 | Compton | 362/298 |

FOREIGN PATENT DOCUMENTS

| | | | |
|---|---|---|---|
| 839981 | 6/1960 | United Kingdom | 362/302 |

*Primary Examiner*—Charles J. Myhre
*Assistant Examiner*—David A. Okonsky
*Attorney, Agent, or Firm*—Pastoriza, Kelly & Lowry

[57] ABSTRACT

An optical system useful in lighting fixtures for uniformly illuminating large areas, includes a plurality of reflectors situated about a light source to cause light emitted by the light source to be concentrated in a first directional range measured from downward vertical, and to provide decreasing intensity of projected light with changes in the angle of projection from the first directional range to downward vertical. In one preferred form, four reflectors, each being a surface of revolution and spaced from the others to preclude any horizontal overlap, are utilized to concentrate the light emitted into a first directional range of about 65 degrees to 75 degrees. All of the light directed into this first directional range is either singly or doubly reflected. Unreflected light passes between a lower reflector and a central reflector to illuminate a middle directional range, and singly reflected light, which is redirected by a portion of an upper reflector, fills a lower directional range. Moreover, the reflectors are situated to prevent the escape of any light above a pre-determined cut-off angle, normally less than 90 degrees, to minimize light pollution and glare.

28 Claims, 4 Drawing Figures

LIGHTING OPTICAL SYSTEM

BACKGROUND OF THE INVENTION

This invention relates generally to lighting fixtures, and, more specifically, to highly efficient optical systems having multiple reflectors which are shaped and positioned to produce an even distribution of light over a broad illuminated area without glare.

The efficiency of lighting fixtures for outdoor illumination purposes is not merely a function of the number of lamp lumens emitted per unit of power consumption, but rather is a combination of several interrelated considerations. For example, an outdoor lighting fixture should illuminate as large an area as possible, and provide uniform lighting throughout the illuminated area. Further, visibility throughout the illuminated area should be maximized while eliminating unneeded glare. This can be accomplished, in part, by minimizing the amount of light thrown into the eyes of drivers or pedestrians, and by preventing the projection of light above the horizontal. Moreover, economic factors such as electric power consumption per illuminated square foot and the cost of lighting fixtures and poles, must be considered in determining the overall efficiency of a system.

It is especially important that rapid changes in the illumination levels over the lighted area be reduced or eliminated to enhance visibility. The effect of providing an even transition from brightly illuminated areas to less well lighted areas is to enhance seeing. Also, a lighting system should direct virtually all of the available light to the intended area of illumination, causing a fairly steep fall-off of illumination at the outer edge of the lighted area.

A number of lighting fixtures have been designed which attempt to satisfy this criteria by providing a plurality of reflectors which intercept light flux from a lamp and shape it into a cone of light which has its maximum candle power directed at a relatively high angle, taken from downward vertical, but less than 90 degrees. Nested reflectors have been used extensively to shape this light cone and to prevent any light from being projected upwardly, with the principle aim of uniformly illuminating a generally circular area. Such prior approaches have usually required the use of a multiplicity of reflectors and/or the use of reflectors having reflecting surfaces of different contours, resulting in light fixtures which are difficult and expensive to manufacture.

Although the size of the lighting fixture can be minimized when many reflectors are utilized, the required multiple reflections of light between the small spaces separating the reflectors reduces the lighting efficiency of the fixture, and results in a luminaire which is difficult to clean. On the other hand, if too few reflectors are utilized, either the luminaire becomes very large for a given performance or it is necessary for the light to be reflected back across the luminaire where the light source and/or its supporting elements interfere with the light and reduce the efficiency of the fixture. Thus, a builder of lighting fixtures is faced with a number of seemingly conflicting and irreconcilable design constraints.

Generally, lighting fixtures should have a very tightly controlled beam for best performance. Besides concentrating the intensity of the beam to provide a higher maximum candle power throughout a selected range, a tightly controlled beam can be more precisely directed at higher vertical angles than less tightly controlled beams to give the fixture a wider area of coverage without increasing glare. This feature results from tight beams having a more clearly defined cut-off angle, which permits their use in wide area illumination coverage in a manner reducing the amount of light directed at nearby drivers and pedestrians.

With point light sources, the beam width can theoretically be made as tight as desired. However, the high intensity discharge lamps used in many outdoor lighting fixtures are not point sources, but instead have light emitting arc tubes of varying lengths. When redirecting light beams by means of one or more reflectors, the tightness of the beam depends on the length of the arc tube and on the distance between the arc tube and the beam forming reflector. To obtain a tight beam with a relatively long arc tube, it is often necessary to provide a larger reflector situated at a greater distance than is desirable or acceptable. As a result, common practice has been to utilize a plurality of reflectors, and to reduce beam width by limiting the portion of the light emitted which is redirected by each reflector. But, as mentioned above, such a practice results in a less than ideal lighting fixture.

Accordingly, there has been a need for a novel lighting fixture which is capable of uniformly illuminating large areas in a highly efficient and economical manner. The improved fixture should utilize an optical system having a minimum number of reflectors for redirecting the emitted light, and be able to advantageously use unreflected and singly reflected light, as well as doubly reflected light, to form the illuminating beams. It would be preferable that both oppositely facing surfaces of each reflector be manufactured to have the same contour and curvature, and that the reflectors be spaced far enough apart to facilitate cleaning and maintenance. Finally, an aesthetically pleasing design which can form a tight beam and minimize glare would be highly desirable. The present invention fulfills these needs and provides other related advantages.

SUMMARY OF THE INVENTION

The present invention resides in an improved optical system which is capable of uniformly illuminating large areas in a highly efficient and economical manner. The optical system comprises generally a plurality of reflectors situated about a light source, which are capable of forming a tight beam and directing that tight beam at a high angle from downward vertical, but less than 90 degrees. Such a tight beam permits the concentration of greater amounts of light far from the light source without increasing glare, by providing a relatively sharp illumination cut-off angle. Moreover, consistent with the provision of a tight beam which concentrates light at the outer perimeter of the area to be illuminated, the optical system of the present invention minimizes changes throughout the illuminated area by utilizing a combination of doubly reflected, singly reflected and unreflected light.

In a preferred form of the invention, the plurality of reflectors includes a central reflector which has planar inner and outer reflecting surfaces. This central reflector is positioned to surround the light source and intercept all of the horizontally emitted light from the light source. The planar inner reflecting surface directs the intercepted, horizontally emitted light downwardly, where it is subjected to further redirection by a lower reflector.

The lower reflector forms an upward and outwardly facing concave reflecting surface which is shaped and positioned to form a tight beam, and directs that beam into a first directional range toward the perimeter of the area being illuminated. Further, the central and lower reflectors are spaced from one another to form a gap through which unreflected light can pass into a middle directional range having a greater downward slope than the light projected into the first directional range. This effective utilization of unreflected light to illuminate the middle range of the illuminated area helps to maximize the efficiency of a lighting fixture by minimizing losses through multiple reflections.

An intermediate reflector is positioned above the central reflector in a manner allowing it to intercept a portion of the light emitted by the light source which is directed above the central reflector, and prevent the escape of any unreflected light between the intermediate and central reflectors. The intermediate reflector includes a concave lower reflecting surface, which forms its intercepted light into a tight beam and directs that beam toward the planar outer reflecting surface of the central reflector. The beam is then simply redirected by the planar outer reflecting surface into the first directional range to further concentrate light near the outer edge of the illuminated area.

Finally, an upper reflector is situated above the intermediate reflector and positioned to intercept all of the light emitted by the light source which is directed above the intermediate reflector in a manner preventing the escape of any light between the upper and intermediate reflectors. The upper reflector includes a central, downwardly facing, planar reflecting surface, and a peripheral concave reflecting surface contiguously extending outwardly from the central reflecting surface. The central reflecting surface directs its intercepted light through the gap between the lower and central reflectors, and into a lower directional range extending substantially from downward vertical up to the middle directional range. On the other hand, the peripheral reflecting surface is shaped to form a tight beam directed into the first directional range.

Due to the positioning and contouring of the reflectors, no light is permitted to escape from the system above a predetermined cut-off angle, normally less than 90 degrees, to minimize light pollution and glare. This can be accomplished with reflectors having similarly contoured surfaces, and without the need to nest adjacent reflectors in a manner causing the lower edge of an upper reflector to horizontally overlap the upper edge of a lower reflector. Moreover, by concentrating the greatest candle power into the first directional range at a high angle from downward vertical, lighting fixtures utilizing the optical system of the present invention can be spaced much further apart than conventional lighting fixtures. This can be done while maintaining acceptable levels of uniform ground illumination.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
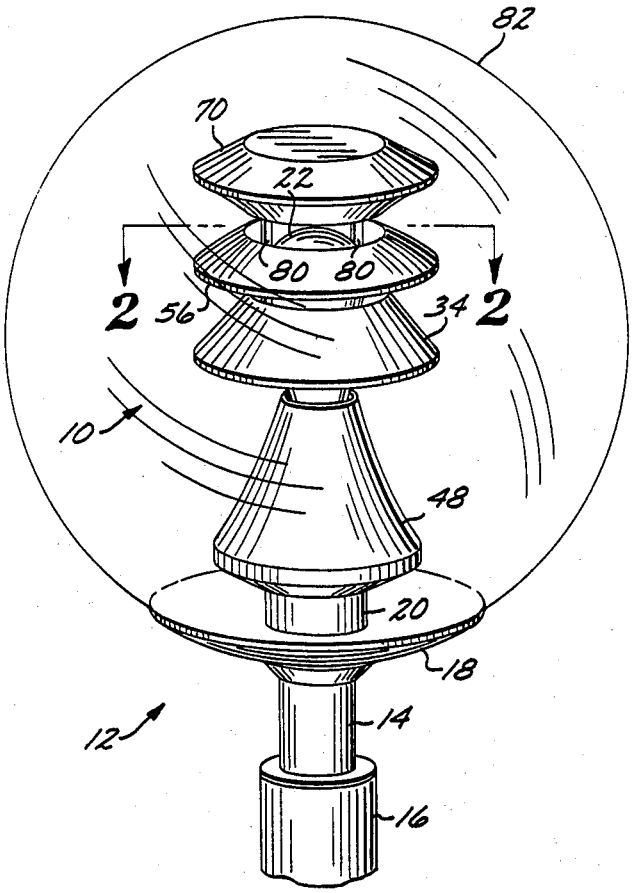
FIG. 1 is a perspective view of a lighting fixture having an optical system embodying the present invention.

As shown in the drawings for purposes of illustration, the present invention is concerned with a novel optical system, generally designated by the reference number 10. In a preferred form of the invention, the optical system 10 is incorporated into a lighting fixture 12 for the efficient and economical illumination of large outdoor areas. As best illustrated in FIG. 1, the lighting fixture 12 is supported at a predetermined height above the ground by a relatively short pole tenon 14 extending upwardly from an elongated vertical supporting pole 16. The upper end of the pole tenon 14 is securely attached to a fitter plate 18 forming the base of the lighting fixture 12, and this fitter plate in turn supports the remainder of the lighting fixture.

Figure 4:
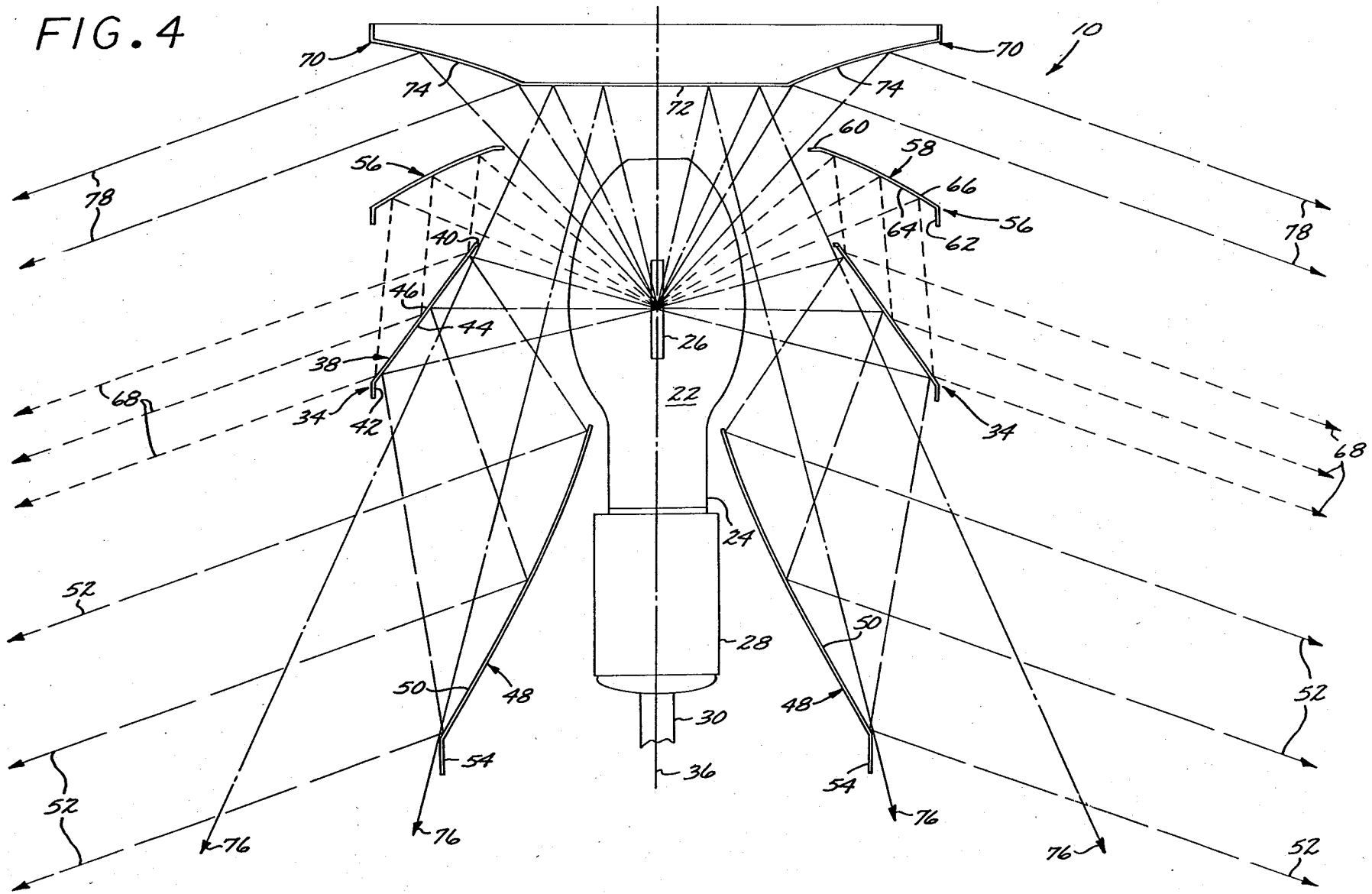
FIG. 4 is an enlarged, fragmented vertical section of the optical system shown in FIG. 1, illustrating the manner in which light emitted from an arc tube is directed to uniformly illuminate a large area while minimizing glare.

Above the fitter plate 18, a ballast 20 is provided for a conventional high output lighting source 22. Such as exemplary lighting source 22 is shown in the drawings in the form of a lamp having a clear envelope 24 which surrounds an elongated, vertically extending arc tube 26 responsible for the emission of light when energized. FIG. 4 schematically illustrates that such a lamp 22 is normally supported within a socket 28 at its lower end, and through this socket electrical energy is provided to the lamp by an upwardly extending power cord 30.

Figure 2:
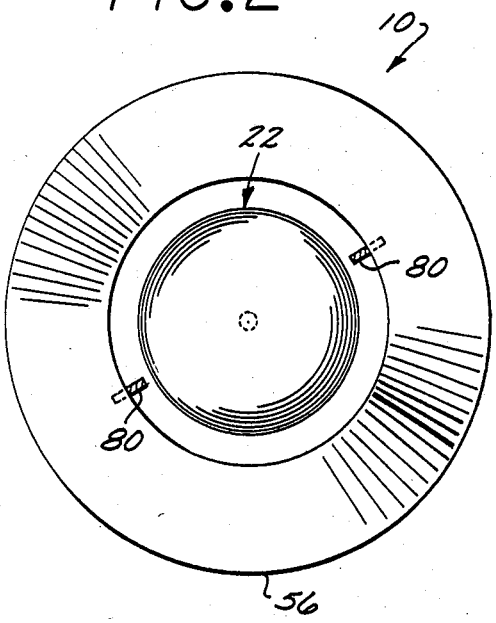
FIG. 2 is an enlarged horizontal section taken generally along the line 2—2 of FIG. 1, illustrating the manner in which an intermediate reflector surrounds a lamp, the two sharing a common vertical axis.

In accordance with the present invention, and as best shown in FIGS. 1, 2 and 4, the optical system 10 includes a plurality of reflectors situated about the light source 22, which are capable of forming a tight beam and directing that tight beam at a high angle from downward vertical, but less than 90 degrees. Such a tight beam permits the concentration of greater amounts of light far from the light source 22 without increasing glare, by providing a relatively sharp illumination cut-off angle. Moreover, consistent with the provision of a tight beam which concentrates light at the outer perimeter of the area to be illuminated, the optical system 10 minimizes changes throughout the illuminated area by utilizing a combination of doubly reflected, singly reflected and unreflected light.

A central reflector 34 is positioned to surround the source of the emitted light, which in this case is the arc tube 26, and intercept all of the horizontally emitted light from that source. This central reflector 34 forms a surface of revolution about a vertical axis 36 coaxially located with the arc tube 26, and includes a planar reflective plate 38 and integral upper and lower reflective skirts 40 and 42 situated, respectively, at the upper and lower edges of the planar reflective plate. These skirts 40 and 42 are included in the illustrated embodiment primarily for improving the aesthetic appearance of the lighting fixture 12, and also to insure that no light is projected from the optical system 10 above a predetermined cut-off angle, as will be more fully explained below. Moreover, the central reflector's planar reflective plate 38 includes oppositely facing, planar inner and outer reflecting surfaces 44 and 46. The planar inner reflecting surface 44 directs the intercepted, horizontally emitted light downwardly, where that light is subjected to further reflection by a lower reflector 48.

Like the central reflector 34, the lower reflector 48 also forms a surface of revolution about the vertical axis 36. This lower reflector 48 has an upward and outwardly facing concave reflecting surface 50, which is shaped and positioned to receive the light directed downwardly by the central reflector 34 and form a tight beam 52 of that light. The outwardly facing concave reflecting surface 50 directs that tightly formed beam 52 into a first directional range toward the perimeter of the area to be illuminated. This first directional range is ideally directed at an angle of 70 degrees from downward vertical, and practically all of the light directed into the first directional range is projected from the optical system 10 between 65 and 75 degrees above downward vertical, with a total cut-off point preventing any light from being reflected at an angle greater than 75 degrees. Additionally, the lower reflector 48 also has an integral, downwardly extending skirt 54 at its lower edge which is provided primarily to enhance the appearance of the lighting fixture 12.

The central and lower reflectors 34 and 48 are spaced from one another far enough to form a sufficiently large gap between them through which unreflected light can pass into a middle directional range. In fact, these two reflectors 34 and 48 are spaced so that the upper edge of the lower reflector 48 is below the lower edge of the central reflector 34, or, in other words, so that there is no horizontal overlap of the reflectors. The unreflected light passing through this gap into the middle directional range has a greater downward slope than the light projected into the first directional range.

More specifically, this middle directional range extends from approximately the first directional range, or 70 degrees, down to an angle of about 25 degrees above downward vertical. Due to the natural distribution of the high intensity discharge lamp 22, the intensity in candela of this unreflected light will gradually decrease with a decreasing angle toward downward vertical, thus providing uniformity of illumination over the lighted area when combined with the light directed into the first directional range, and fill light directed below 25 degrees which will be more fully discussed below. This effective utilization of unreflected light to illuminate the middle range of the illuminated area helps to maximize the efficiency of the lighting fixture 12 by minimizing losses through multiple reflections.

Next, an intermediate reflector 56 is positioned above the central reflector 34 in a manner allowing it to intercept a portion of the light emitted by the light source 22 which is directed above the central reflector, and prevent the escape of any unreflected light between the intermediate and central reflectors. The intermediate reflector 56 is similar to the central reflector 34 in that it forms a surface of revolution about the vertical axis 36, and includes a central curved portion 58 bounded at the upper and lower edges by skirts 60 and 62. These skirts 60 and 62 perform the same function as those found on the central reflector 34.

The central curved portion 58 of the intermediate reflector 56 has similarly curved lower concave and upper convex reflecting surfaces 64 and 66. The lower concave reflecting surface 64 forms the light intercepted by the intermediate reflector 56 into a tight beam 68, and directs that beam toward the planar outer reflecting surface 46 of the central reflector 34. The beam 68 is then simply redirected by the planar outer reflecting surface 46 into the first directional range, to combine with the doubly reflected light redirected by the lower reflector 48 and further concentrate light near the outer edge of the illuminated area. Although the upper convex surface 66 is normally specularly reflective, this type of construction is not necessary for the proper operation of the optical system 10 because it is not utilized to reflect any light.

Finally, situated directly above both the light source 22 and the intermediate reflector 56 is an upper reflector 70 which is positioned to intercept all of the light emitted by the light source which is directed above the intermediate reflector. Like the intermediate reflector 56, the upper reflector 70 importantly prevents the escape of any light between those two reflectors, and accomplishes this without any horizontal overlap between adjacent reflectors. Further, the upper reflector 70 forms a generally circular surface of revolution about the vertical axis 36, and this vertical axis passes through the center of the upper reflector.

For redirecting the intercepted light, the upper reflector 70 includes a central, downwardly facing, planar reflecting surface 72, and a peripheral concave reflecting surface 74 contiguously extending outwardly from the central, horizontally planar reflecting surface. The central reflecting surface 72 directs its intercepted light 76 through the gap between the lower and central reflectors 48 and 34, and into a lower directional range extending substantially from downward vertical up to approximately the lower extent of the middle directional range. This lower directional range typically extends from about 8 to 25 degrees from downward vertical. On the other hand, the peripheral reflecting surface 74 is shaped to form a tight beam 78 of singly reflected light directed into the first directional range.

All four of the reflectors 34, 48, 56 and 70 are supported about the vertical axis 36 by a pair of support rods 80 in a conventional manner. The upper reflector 70 is easily removable from the support rods 80 to provide convenient access to the lamp 22 for maintenance purposes and the like. Moreover, the optical system 10 is usually housed within a transparent enclosure 82 shaped substantially like a sphere to protect the reflectors 34, 48, 56 and 70, the light source 22, and the associated fixture members from the elements.

In the present invention, the number of reflectors is reduced to a practical minimum while still providing control of the light emitted so that the light directed by the reflectors can be combined with unreflected light to uniformly illuminate a given area. Highly efficient lighting is achieved by maximum use of unreflected light, and by minimizing the number of multiple reflections to which the light is subjected. Further, the lamp position and the size of the arc tube 26 is carefully correlated with the reflectors to provide a well defined cut-off angle above which the projection of light is prevented, without the necessity of using the reflectors as merely delimiting shields. This characteristic of the novel optical system 10 desirably allows wider spacings between adjacent reflectors, which in turn facilitates cleaning and maintenance of the lighting fixture 12.

The single contours of the oppositely facing surfaces on the intermediate, central and lower reflectors 56, 34 and 48 further economize the optical system 10 of the present invention. The contours of these three reflectors are correlated so that both the top and bottom surfaces of each reflector can have the same overall shape. This type of reflector is much easier and cheaper to produce than other multiple contour reflectors found in prior lighting fixtures.

Figure 3:
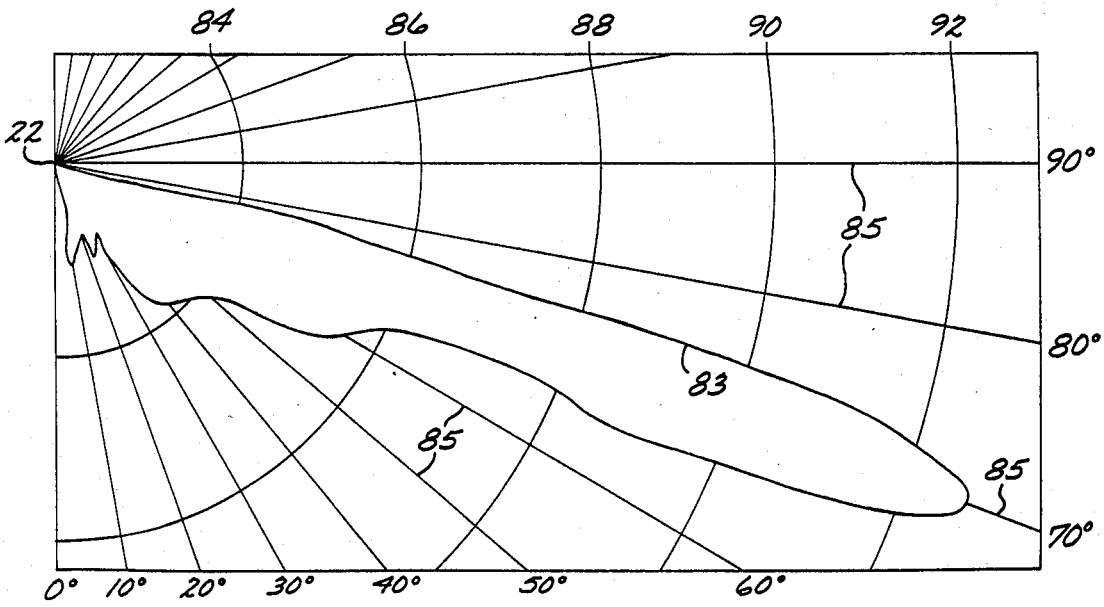
FIG. 3 illustrates the candle power distribution curve achieved by the optical system of FIG. 1.

Referring now to the lighting characteristics of a fixture utilizing the optical system 10 of the present invention, a typical candle power distribution curve 83 for the design is shown in FIG. 3. In that Figure, the radially extending lines 85 indicate the angle of projection of light from downward vertical. It should be noted that the beam of maximum candle power is directed generally at an angle of 70 degrees, and the width of this beam is approximately 10 degrees. This very tight light control, combined with the high efficiency of the optical system 10, allows a single unit at a given mounting height to illuminate an area about 40 percent greater than most prior units, to the same minimum illumination level. This results in an energy savings of roughly 30 percent, and a savings in fixture and installation costs of a similar magnitude. If the light source 22 used is a 150 watt, clear, high pressure sodium lamp rated at 16000 lumens, the five arced candle power curves 84, 86, 88, 90 and 92 would be labeled, respectively, 1000 to 5000.

This candle power distribution curve 83 also indicates that there will not be a sharp line of demarcation between a maximum intensity at the outer edge of the area to be illuminated, and an unlighted area. Rather, there is a fall off of illumination at the edge which, while not abrupt, is fairly steep.

From the foregoing it is to be appreciated that due to the positioning and contouring of the reflectors, no light is permitted to escape from the system above a predetermined cut-off angle, to minimize light pollution and glare. This is accomplished with reflectors having similarly contoured surfaces, and without requiring any horizontal overlap of adjacent reflectors. By concentrating the greatest candle power into the first directional range at a high angle from downward vertical, lighting fixtures utilizing the optical system 10 can be spaced much further apart than conventional lighting fixtures. Moreover, this can be done while maintaining acceptable levels of uniform ground illumination.

Although a particular embodiment of the invention has been described in detail for purposes of illustration, various modifications may be made without departing from the spirit and scope of the invention. For example, notwithstanding the fact that the normal utility of the above-described luminaire is for the symmetrical distribution of light, the addition of various reflectors or lens elements internally or externally to produce asymmetrical distributions should not be precluded. Accordingly, the invention is not to be limited, except as by the appended claims.

I claim:

1. A reflector system for concentrating light emitted by a light source into a first directional range measured from downward vertical, and for providing decreasing intensity of projected light with changes in the angle of projection from the first directional range to downward vertical, said system comprising:

a lower reflector having an upward and outwardly facing concave reflecting surface;

a central reflector positioned above said lower reflector and having planar inner and outer reflecting surfaces, said central reflector being situated to surround the light source to intercept all horizontally emitted light, redirect that intercepted light to said lower reflector which in turn concentrates that light into the first directional range measured from downward vertical, the spacing between said lower reflector and said central reflector creating a lower gap through which unreflected light can pass into a middle directional range having a greater downward slope than light projected into the first directional range;

an intermediate reflector positioned above said central reflector and having similarly curved, convex upper and concave lower surfaces, said intermediate reflector being situated to intercept a portion of the light emitted by the light source which is directed above said central reflector in a manner to prevent the escape of any unreflected light between said central and intermediate reflectors, and redirect that intercepted light to said planar outer reflecting surface of said central reflector which in turn reflects that light into the first directional range measured from downward vertical; and an upper reflector positioned above said intermediate reflector and having a central, downwardly facing, planar reflecting surface, and a downward and outwardly facing, peripheral concave reflecting surface contiguously extending outwardly from said central reflecting surface, said upper reflector being situated to intercept all of the light emitted by the light source which is directed above said intermediate reflector in a manner to prevent the escape of any unreflected light between said upper and intermediate reflectors, said central reflecting surface redirecting a portion of the light intercepted by said upper reflector through said lower gap and into a lower directional range extending substantially from downward vertical up to said middle directional range, said peripheral concave reflecting surface redirecting the remainder of the light intercepted by said upper reflector through an upper gap between said upper and intermediate reflectors, the light passing through said upper gap being concentrated into the first directional range.

2. A system as set forth in claim 1, wherein the upper edge of said lower reflector is below the lower edge of said central reflector.

3. A system as set forth in claim 1, wherein the upper edge of said central reflector is below the lower edge of said intermediate reflector.

4. A system as set forth in claim 1, wherein the upper edge of said intermediate reflector is below the lower edge of said upper reflector.

5. A system as set forth in claim 1, wherein a portion of each of said reflectors forms a surface of revolution taken about an axis passing through the light source.

6. A system as set forth in claim 1, including a pair of vertical support members which rigidly position said reflectors about the light source.

7. A system as set forth in claim 1, including means to cut off all light emitted by the light source above a pre-determined cut-off angle from downward vertical greater than the first directional range and less than 90 degrees.

8. An optical system for reflecting light emitted by a light source, said system comprising:

a central reflector positioned to surround the light source in a manner permitting an inwardly facing reflecting surface to intercept all horizontally emitted light and redirect that light, said central reflector having planar surfaces in cross-section;

means for reflecting the light redirected by said inwardly facing reflecting surface of said central reflector into a first directional range;

means for permitting light emitted toward a middle directional range, having a greater downward slope than light directed into said first directional range, to escape from said system without reflection; and means for intercepting the light emitted by the light source which is directed about said central reflector in a manner to prevent the escape of any unreflected light between said intercepting means and said central reflector, said intercepting means redirecting a portion of the intercepted light into a lower directional range extending substantially from downward vertical up to said middle directional range, and another portion of the intercepted light into said first directional range.

9. A system as set forth in claim 8, wherein said reflecting means is spaced from and situated below said central reflector, and includes an upward and outwardly facing concave reflecting surface.

10. A system as set forth in claim 8, including means to cut off all light emitted by the light source above a pre-determined cut-off angle from downward vertical greater than said first directional range and less than 90 degrees.

11. A system as set forth in claim 10, wherein said cut-off angle is about 75 degrees.

12. A system as set forth in claim 8, wherein said first directional range extends from about 65 degrees to about 75 degrees from downward vertical.

13. A system as set forth in claim 12, wherein said lower directional range extends from about 8 degrees to 25 degrees from downward vertical.

14. A system as set forth in claim 8, wherein said intercepting means includes an upper reflector positioned above and spaced from said central reflector, said upper reflector having a central planar and downwardly facing reflecting surface, and a downward and outwardly facing peripheral concave reflecting surface contiguously extending outwardly from said central reflecting surface, said central reflecting surface redirecting said portion of intercepted light which is redirected into said lower directional range, through said permitting means, and said peripheral concave reflecting surface redirecting at least a part of said portion of the intercepted light which is redirected into said first directional range.

15. A system as set forth in claim 14, wherein said intercepting means includes an intermediate reflector which is spaced from and situated between both said upper reflector and said central reflector, said intermediate reflector having a concave lower reflecting surface situated to intercept the part of said portion of the intercepted light which is redirected into said first directional range and which is not redirected by said peripheral concave reflecting surface, said concave lower reflecting surface directing that part of light toward an outwardly facing reflecting surface provided on the opposite side of said central reflector with respect to said inwardly facing reflecting surface.

16. A system as set forth in claim 15, wherein said reflectors are spaced from one another so that the upper edge of each is below the lower edge of the next higher one.

17. A system as set forth in claim 15, wherein at least a portion of each of said reflecting surfaces is a surface of revolution situated about a main axis passing through the center of each of said reflectors, to surround the light source in a manner causing light emitted by the light source to be concentrated in said first directional range, and to provide decreasing intensity of projected light with changes in the angle of projection from said first directional range to downward vertical.

18. A system as set forth in claim 17, wherein the light source provides an arc tube having a longitudinal axis coaxially located with said main axis passing through the center of each of said reflectors.

19. A system as set forth in claim 18, including a transparent sphere which substantially encloses the light source and said reflectors.

20. An optical system for uniformly illuminating large areas, said system comprising:

a light source having a vertical arc tube situated coaxially with a vertical axis of said optical system; and a plurality of reflectors being vertically spaced apart from one another to preclude any horizontal overlap, each of said plurality of reflectors being a surface of revolution situated about said axis to surround said light source in a manner causing light emitted by said arc tube to be concentrated in a first directiona range measured from downward vertical, and to provide decreasing intensity of projected light with changes in the angle of projection from said first directional range to downward vertical, said plurality of reflectors including:

a lower reflector situated to generally surround a lower portion of said light source, said lower reflector having an upward and outwardly facing concave reflecting surface;

a central reflector positioned above said lower reflector and having planar inner and outer reflecting surfaces, said central reflector being situated to surround said arc tube to intercept all horizontally emitted light from said light source, redirect that intercepted light to said lower reflector which in turns concentrates that light into said first directional range measured from downward vertical, the spacing between said lower reflector and said central reflector creating a lower gap through which unreflected light can pass into a middle directional range having a greater downward slope than light projected into said first directional range;

an intermediate reflector positioned above said central reflector and having similarly curved, convex upper and concave lower surfaces, said intermediate reflector being situated to intercept a portion of the light emitted by said light source which is directed above said central reflector in a manner to prevent the escape of any unreflected light between said central and intermediate reflectors, and redirect that intercepted light to said planar outer reflecting surface of said central reflector which in turn reflects that light into said first directional range measured from downward vertical; and an upper reflector positioned above said intermediate reflector and having a central, downwardly facing reflecting surface, and a downward and outwardly facing peripheral concave reflecting surface contiguously extending outwardly from said central reflecting surface, said upper reflector being situated to intercept all of the light emitted by said light source which is directed above said intermediate reflector in a manner to prevent the escape of any unreflected light between said upper and intermediate reflectors, said central reflecting surface redirecting a portion of the intercepted light through said lower gap and into a lower directional range extending substantially from downward vertical up to said middle directional range, said peripheral concave reflecting surface redirecting the remainder of the light intercepted by said upper reflector through an upper gap between said upper and intermediate reflectors, the light passing through said upper gap being concentrated into said first directional range.

21. A system as set forth in claim 20, including a pair of vertical support members which rigidly position said plurality of reflectors.

22. A system as set forth in claim 20, including a transparent envelope which substantially encloses said light source and plurality of reflectors.

23. A system as set forth in claim 22, wherein said envelope is shaped substantially as a sphere.

24. A system as set forth in claim 20, including means to cut off all light emitted by said light source above a predetermined cut-off angle from downward vertical greater than said first directional range and less than 90 degrees.

25. A system as set forth in claim 24, wherein said cut-off angle is about 75 degrees.

26. A system as set forth in claim 20, wherein said first directional range extends from about 65 degrees to about 75 degrees from downward vertical.

27. A system as set forth in claim 26, wherein said middle directional range extends from about 25 degress to about 65 degrees.

28. A system as set forth in claim 27, wherein said lower directional range extends from about 8 degrees to about 25 degrees.

* * * * *

UNITED STATES PATENT AND TRADEMARK OFFICE

CERTIFICATE OF CORRECTION

PATENT NO. : 4,591,960

DATED : May 27, 1986

INVENTOR(S) : Bill F. Jones

It is certified that error appears in the above-identified patent and that said Letters Patent is hereby corrected as shown below:

In Column 4, line 33, please delete the word "as" and insert therefor --an--.

In Column 10, line 31, please delete the word "directiona" and insert therefor --directional-- .

Signed and Sealed this

*Twenty-sixth* Day of *August 1986*

[SEAL]

*Attest:*

DONALD J. QUIGG

*Attesting Officer*

*Commissioner of Patents and Trademarks*

UNITED STATES PATENT AND TRADEMARK OFFICE

CERTIFICATE OF CORRECTION

PATENT NO. : 4,591,960

DATED : May 27, 1986

INVENTOR(S) : Bill F. Jones

It is certified that error appears in the above-identified patent and that said Letters Patent is hereby corrected as shown below:

In Column 9, line 15, delete the word "about" and insert therefor --above--.

Signed and Sealed this

Eighteenth Day of November, 1986

*Attest:*

DONALD J. QUIGG

*Attesting Officer* *Commissioner of Patents and Trademarks*